United States Patent [19]

Andersen

[11] Patent Number: 4,802,580

[45] Date of Patent: Feb. 7, 1989

[54] MAGNETIC SOCKET AND TOOL HOLDER

[76] Inventor: Timm Andersen, 505 W. Pickett Creek Rd., Grants Pass, Oreg. 97527

[21] Appl. No.: 134,041

[22] Filed: Dec. 17, 1987

[51] Int. Cl.[4] ..... B65D 85/70; A47F 5/08; H01F 7/20

[52] U.S. Cl. ..... 206/378; 206/350; 206/818; 211/70.6; 211/DIG. 1; 248/206.5; 248/309.9; 335/285

[58] Field of Search ..... 206/378, 372, 350, 818, 206/349, 376; 211/70.6, DIG. 1, 69; 248/37.6, 206.5, 206 A, 220.9, 220.3, 309.9; 335/285

[56] References Cited

U.S. PATENT DOCUMENTS

| | | | |
|---|---|---|---|
| 2,457,032 | 12/1948 | Case | 206/818 X |
| 2,955,789 | 10/1960 | Smith | 211/70.6 |
| 2,966,992 | 1/1961 | Dunkelberger et al. | 335/285 |
| 3,204,776 | 9/1965 | Brown et al. | 211/70.6 X |
| 3,229,820 | 1/1966 | Hentzi et al. | 211/70.6 |
| 3,405,377 | 10/1968 | Pierce | 206/378 X |
| 4,337,860 | 7/1982 | Corrigan | 206/378 X |
| 4,451,810 | 5/1984 | Miller | 335/285 |
| 4,544,067 | 10/1985 | Miller | 211/70.6 |
| 4,591,817 | 5/1986 | Miller | 335/285 |
| 4,682,698 | 7/1987 | Handler et al. | 211/70.6 |

*Primary Examiner*—Jimmy G. Foster
*Assistant Examiner*—Bryon Gehman
*Attorney, Agent, or Firm*—Fleit, Jacobson, Cohn & Price

[57] ABSTRACT

A pair of elongated parallel and laterally spaced apart armature plates are provided between which a plurality of permanent magnets are mounted in positions spaced along the plates and the plates are constructed of ferrous material. One pair of corresponding longitudinal side edges of the plates may be engaged with a ferrous object for support of the plates and magnets therefrom and the other pair of corresponding side edges of the plates may have tools such as sockets supported therefrom and removably magnetically attracted thereto. A positioning or abutment plate paralleling the armature plates and spaced slightly outward of the side of one of the armature plates remote from the other armature plate is included on the holder and the marginal portion of the positioning plate corresponding to the second pair of corresponding edges of the armature plates extends appreciably edgewise outwardly therebeyond and may be abutted by the opposing surfaces of the sockets supported from the second pair of corresponding edges of the armature plates, the positioning plate being constructed of non-ferrous material.

8 Claims, 1 Drawing Sheet

MAGNETIC SOCKET AND TOOL HOLDER

BACKGROUND OF THE INVENTION

1. Field of the Invention

An elongated magnetic support is provided for magnetic attachment to a ferrous surface and for magnetic support of tools such as sockets therefrom, the support including combined handle and socket positioning means thereon whereby the support readily may be removed from a ferrous object to which it is magnetically attracted and a plurality of sockets to be supported from the support may be arranged in a precisely aligned row of sockets to ensure maximum magnetic attraction between the support and the sockets.

2. Description of Related Art

Various different forms of magnetic tool support structures including some of the general structural and operational features of the instant invention heretofore have been provided. Examples of these previously known forms of magnetic holders are disclosed in U.S. Pat. Nos. 3,405,377, 4,043,453, 4,150,746, 4,337,860, 4,482,049 and 4,586,616. However, these previously known forms of magnetic supports are not specifically designed to support a plurality of different size sockets therefrom in a precisely aligned row of sockets and in a manner accomplished by the holder of the instant invention.

SUMMARY OF THE INVENTION

The socket holder of the instant invention incorporates a pair of parallel armature plates between which a plurality of permanent magnets are supported and an abutment plate is supported outwardly of the side of one of the armature plates remote from the other armature plate. The armature plates include first and second pairs of corresponding opposite side longitudinal edges and each pair of corresponding edges is substantially coplanar. The first set of corresponding edges is adapted to abut and to be magnetically attracted to a ferrous supporting object for support of the support therefrom and the second set of corresponding edges is adapted to have ferrous objects such as sockets abutted thereagainst and magnetically attracted thereto.

The marginal portion of the abutment plate corresponding to the second marginal edges of the armature plates projects edgewise outwardly beyond the latter and is spaced outward of the adjacent armature plate. The abutment plate is provided as an alignment or positioning plate and sockets engaged with the second marginal edges of the abutment plate are abutted against the abutment plate for precise row alignment of the sockets supported from the holder and positioning of the sockets relative to the second corresponding marginal edges of the armature plates with which the sockets are engaged. Further, the outwardly projecting margin of the abutment plate also serves as a handle necessary for removing the holder, and the sockets supported therefrom, from engagement with a ferrous support therefor.

The main object of this invention is to provide a tool holder for sockets and wherein the tool holder may be supported from substantially any vehicle component or other work surface other than those constructed of non-ferrous materials.

Another object of this invention is to provide a tool holder having a magnetic attraction for an attendant support structure considerably greater than the total magnetic attraction between a plurality of tools such as sockets supported from the holder, whereby several sockets may be simultaneously removed from the holder independent of the holder being disengaged from the ferrous support structure therefor.

Still another object of this invention is to provide a magnetic tool holder which will support a plurality of tools such as sockets therefrom in a manner preventing accidental dislodgement of the sockets from the holder.

An ancillary object of this invention is to provide a tool holder in accordance with the preceding objects and constructed in a manner whereby different types of tools may be supported therefrom.

A further object of this invention is to provide a magnetic tool holder which, by its magnetic properties, may be self-supporting from a ferrous material workbench or a ferrous support structure mounted on a non-ferrous workbench.

A final object of this invention to be specifically enumerated herein is to provide a tool holder in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
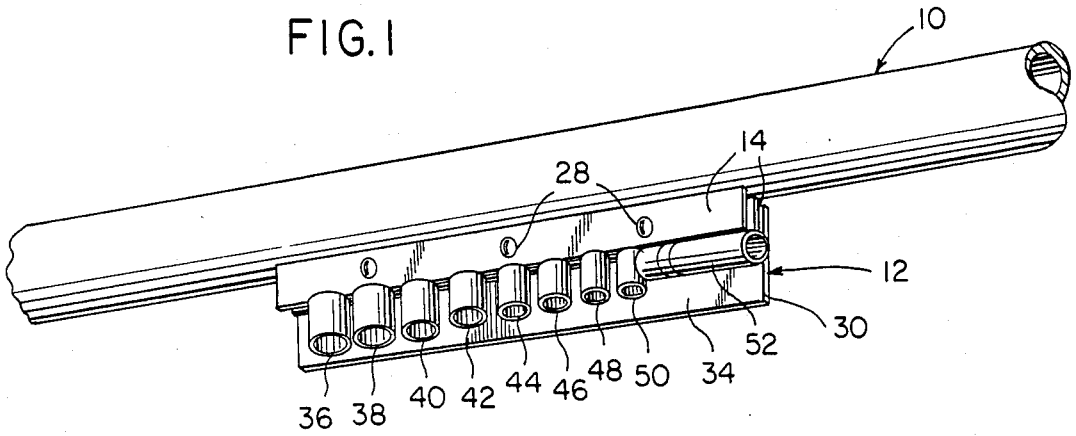
FIG. 1 is a fragmentary perspective view of a torque tube (drive shaft) of a vehicle with the tool holder of the instant invention magnetically supported from the underside of the torque tube and a plurality of tools (sockets) supported from the tool holder.
Figure 2:
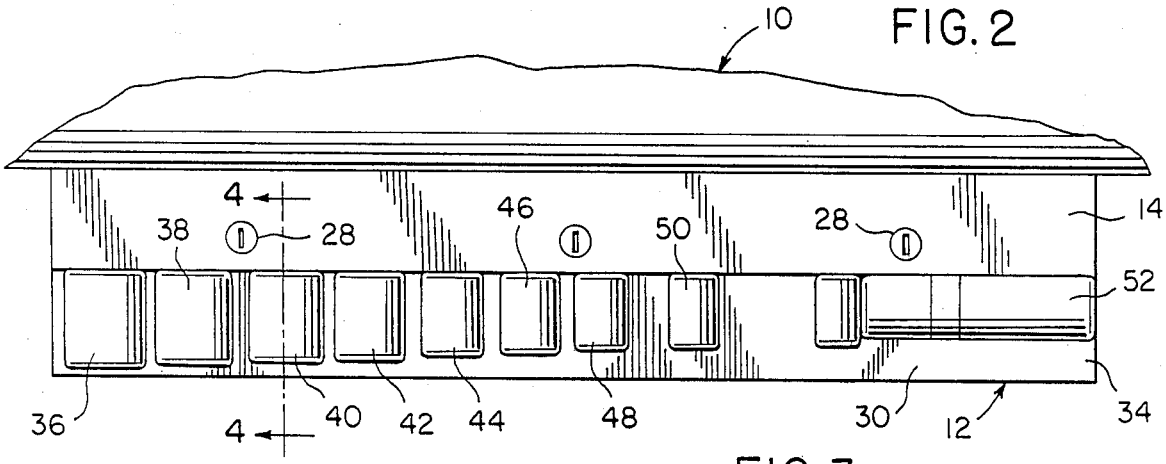
FIG. 2 is a fragmentary enlarged side elevational view of the central portion of the assemblage illustrated in FIG. 1.

Referring now more specifically to the drawings, the numeral 10 generally designates a torque tube (drive shaft) of a conventional form of motor vehicle and the reference numeral 12 generally designates the tool holder of the instant invention.

The tool holder 12 incorporates a pair of parallel, laterally spaced apart and opposite side armature plates 14 between which a plurality of permanent magnets 16, .18, 20 and 22 are secured. The plates 14 include a first pair of corresponding opposite side longitudinal edges 24 as well as a second pair of corresponding opposite side longitudinal edges 26. The edges 24 are coplanar, as are the edges 26 and the armature plates 14 are constructed of ferrous material.

A plurality of threaded fasteners 28 extend and are secured between and through the plates 14 and clamp the magnets 16, 18, 20 and 22 therebetween. In addition, the fasteners 28 may extend through transverse bores (not shown) formed in the magnets in order to further secure the magnets in position between the plates 14.

An abutment plate 30 is spaced outward of the side of one of the plates 14 remote from the other armature plate 14 and supported from the tool holder by the fasteners 28, a plurality of sets of washers 32 being disposed about the fasteners 28 between the abutment plate 30 and the adjacent armature plate 14. Thus, the armature plate 30 is supported in spaced relation relative to the adjacent armature plate 14.

Figure 4:
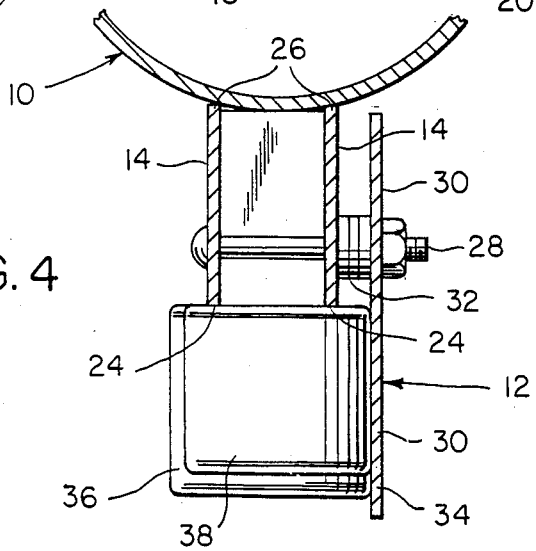
FIG. 4 is a fragmentary enlarged vertical sectional view taken substantially upon the plane indicated by the section line 4—4 of FIG. 2.

The marginal edge portion 34 of the abutment plate 30 corresponding to the edges 24 of the plates 14 projects considerably edgewise outwardly therefrom and a plurality of tools such as different size sockets 36–52 may be supported from the edges 24 in the manner illustrated in FIGS. 1 and 4 with the sockets abutted against the abutment plate 30. In this manner, the sockets 36-52 are positioned on the edges 24 in precise row alignment therealong. The abutment plate 30 is constructed of non-ferrous material (although ferrous materials may be used in some instances) and, therefore, the sockets 36–52 are not magnetically attracted to the abutment plate 30.

Accordingly, if the holder 12 is supported from the torque tube 10 in the manner illustrated in FIG. 1 and a mechanic desires to remove perhaps three sockets 40, 42, 44 from the holder 12 at the same time, the mechanic may insert the tips of three fingers into the sockets 42, 44 and 46 and remove the sockets from the holder 12 without the holder being removed from the torque tube 10. If the abutment plate 30 was constructed of ferrous material, the additional magnetic attraction of the sockets 40, 42 and 44 to such a ferrous abutment plate 30 might increase the pull required to remove the sockets 40, 42 and 44 from the holder 12 to an extent such that an attempt to remove the sockets 40, 42 and 44 from the holder 12 would result in the holder 12 being removed from the torque tube 10.

Figure 3:
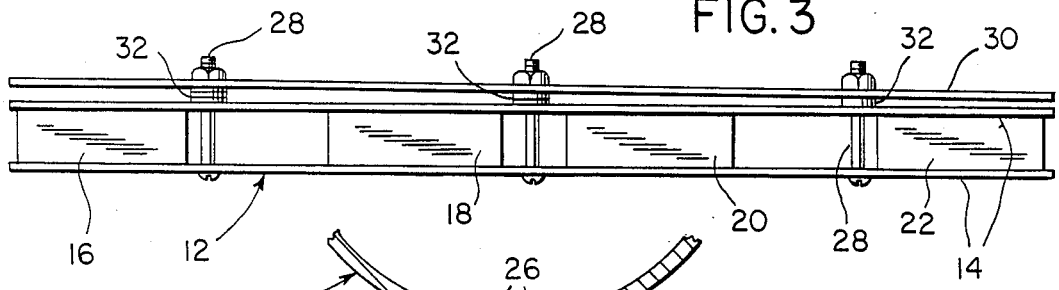
FIG. 3 is a top plan view of the tool holder illustrated in FIG. 2 with the sockets removed.

The sockets 36–52 illustrated differ only slightly in size and, accordingly, the abutment plate 30 substantially parallels the adjacent armature plate 14. However, if the sockets 36–52 varied a greater amount in size, one of the washers 32 on the center fastener 28 could be removed and two of the washers on the right-hand fastener 28 in FIG. 3 could be removed, whereby the right-hand end of the abutment plate 30 would be inclined toward the right-hand end of the adjacent armature plate 14. In this manner, a set of sockets differing more greatly in size and butted against the abutment plate 30 would still be maintained substantially centered relative to the armature plates 14, thereby assuring maximum attraction between the armature plates 14 and the sockets supported therefrom.

Further, it is to be noted that the holder 12 illustrated in the drawings has been constructed to support a plurality of medium size sockets therefrom. If the holder 12 is to be used in conjunction with a smaller set of sockets, the thickness of the magnets 16, 18, 20 and 24 would be reduced so as to reduce the spacing between the armature plates 14. Conversely, if the set of sockets to be supported from the holder 10 are larger and heavier, the thickness of the magnets 16, 18, 20 and 22 is to be increased thereby spacing the armature plates 14 a greater distance apart. Also, the holder 10 may be made as long as desired to accommodate an even greater number of sockets, particularly if the holder is to be maintained on a workbench, in which instance the holder may be made sufficiently long to accommodate substantially all frequently used size sockets and possibly deep sockets of varying sizes as well as short sockets. In this manner, a large number of sockets may be stored in an orderly manner for ready access, the socket holder 12 not including projections which must be received within the back ends of sockets and therefore enabling sockets to be removably supported therefrom in substantially any position relative to the holder as long as the sockets being held bridge the edges 24.

Also, the outwardly projecting marginal portion of the plate 30 serves as a handle to facilitate removal of the holder 12, and all of the tools supported therefrom, from a supporting object such as the torque tube 10. Further, the edges 26 are disposed in a plane spaced outward from the corresponding edge of the plate 30, thereby enabling the edge portion 34 of plate 30 to be used as a handle to initially angularly displace that holder 12 about the edge 26 of the plate 14 adjacent plate 30 to displace the other edge 26 out of engagement with a ferrous surface, such as the torque tube 10, before attempting to completely displace the holder 12 from the torque tube 10.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A magnetic socket and tool holder including a pair of elongated ferrous material, laterally spaced apart and generally parallel armature plates, a plurality of permanent magnets supported between said plates and spaced longitudinally therealong, said plates including first and second pairs of generally coplanar corresponding opposite side longitudinal edges, said first pair of corresponding edges being abutable against a ferrous object for magnetic support of said holder therefrom and said second pair of corresponding edges defining abutment edges to be abutted and spanned by a plurality of ferrous objects spaced along said plates for removable magnetic support of said objects therefrom, a positioning plate generally paralleling and supported and laterally spaced from one of said armature plates on the side thereof remote from the other armature plate, said positioning plate including one longitudinal marginal portion corresponding to said second pair of corresponding edges and projecting appreciably edgewise outwardly therebeyond, said one longitudinal marginal portion defining a handle as well as an abutment plate portion to be abutted by the opposing surfaces of said ferrous objects for proper alignment of said objects along said second pair of corresponding plate edges.

2. The holder of claim 1 wherein said positioning plate is constructed of non-ferrous material.

3. The holder of claim 1 wherein said positioning plate is supported from said one armature plate through the utilization of support means including adjustment means for slightly inclining said positioning plate relative to said one armature plate in a manner such that one ned of said positioning plate is convergent toward the corresponding end of said one armature plate.

4. The holder of claim 1 wherein the spacing between said armature plates is appreciably greater than the spacing between said one longitudinal marginal portion of said positioning plate and the adjacent armature plate.

5. The holder of claim 1 wherein said first pair of corresponding edges of said armature plates are disposed in a plane spaced outwardly of the marginal portion of said positioning plate opposite said one longitudinal marginal portion thereof.

6. The holder of claim 5 wherein said positioning plate is constructed of non-ferrous material.

7. The holder of claim 6 wherein said positioning plate is supported from said one armature plate through the utilization of support means including adjustment means for slightly inclining said positioning plate relative to said one armature plate in a manner such that one end of said positioning plate is convergent toward the corresponding end of said one armature plate.

8. The holder of claim 7 wherein the spacing between said armature plates is appreciably greater than the spacing between said one longitudinal marginal portion of said positioning plate and the adjacent armature plate.

* * * * *